US006032844A

United States Patent [19]

Hartzog et al.

[11] Patent Number: 6,032,844

[45] Date of Patent: Mar. 7, 2000

[54] AIR JET PIDDLING

[75] Inventors: James Victor Hartzog, Kinston; Darren Scott Quinn, Goldsboro, both of N.C.

[73] Assignee: E. I. du Pont de Nemours and Company, Wilmington, Del.

[21] Appl. No.: 08/904,167

[22] Filed: Jul. 31, 1997

[51] Int. Cl.[7] ..... B65H 20/00; B65H 54/76; D04H 11/00; D02G 1/16

[52] U.S. Cl. ..... 226/97.4; 19/159 R; 28/274; 28/289

[58] Field of Search ..... 226/97.4; 28/274, 28/289; 19/159 R

[56] References Cited

U.S. PATENT DOCUMENTS

| | | | |
|---|---|---|---|
| 2,173,789 | 9/1939 | Nikles et al. | 226/97.4 X |
| 2,447,982 | 8/1948 | Koster . | |
| 2,721,371 | 10/1955 | Hodkinson et al. . | |
| 2,971,243 | 2/1961 | Burns . | |
| 3,052,010 | 9/1962 | Martin . | |
| 3,135,038 | 6/1964 | Pflugrad . | |
| 3,270,977 | 9/1966 | Tillou, II . | |
| 3,281,913 | 11/1966 | Morehead et al. . | |
| 3,387,756 | 6/1968 | Goodner . | |
| 3,580,445 | 5/1971 | Moore, Jr. et al. . | |
| 3,706,407 | 12/1972 | King et al. . | |
| 3,951,321 | 4/1976 | Heusser | 226/97.4 |
| 4,098,444 | 7/1978 | Cole | 226/97.4 |
| 4,414,790 | 11/1983 | Sighieri et al. | 226/97.4 X |
| 4,784,344 | 11/1988 | Lenk et al. | 226/97.4 X |
| 5,326,009 | 7/1994 | Kobayashi et al. | 226/97.4 |

FOREIGN PATENT DOCUMENTS 367371 3/1963 Switzerland .

OTHER PUBLICATIONS

Nippon Ester Co. Ltd., Yarn Housing Method, *Patent Abstract of Japan 07172694*, vol. 095, No. 010, Jul. 11, 1995.

Toray Ind Inc., High Speed Yarn Swing Device, *Patent Abstract of Japan 54116562*, vol. 003, No. 140, Sep. 10, 1979.

Kawasaki Steel Corp, Production of Filament Pitch Fiber and Air Ejector Used Therefor, *Patent Abstract of Japan 63042921*, vol. 012, No. 258, Feb. 24, 1988.

Murata Mach Ltd., Housing Device of Carbon Fiber, *Patent Abstract of Japan 57126353*, vol. 006, No. 220, Aug. 6, 1982.

*Primary Examiner*—Michael R. Mansen

[57] ABSTRACT

An aspirating jet piddler that has no moving parts and operates by swirling a textile tow line pneumatically to achieve a soft laydown with reduced tangling.

3 Claims, 3 Drawing Sheets

AIR JET PIDDLING

FIELD OF THE INVENTION

This invention relates to improvements in and relating to air jet piddling, and more particularly to an improved piddler that uses an air jet and to an improved process relating thereto and to improved products obtained thereby.

BACKGROUND OF THE INVENTION

An integral step in many processes or systems for the production of textile fibers has been the collection of a rapidly moving filamentary strand in a container for transport to the next processing step. This process, often called piddling or canning, provides a means by which one or more filamentary strands (sometimes referred to as tow or rope) can be collected and possibly combined before processing through a draw/crimp step, which is often performed at a speed that has generally been much slower than the previous step, such as, for example, spinning a synthetic polymer to form synthetic filaments. A long-standing problem in the piddling process has been how to deposit such a rapidly-moving strand (e.g., a tow line) into the can in such a way as to avoid entanglements that may occur or be a problem upon subsequent removal of product from the can. Several methods are available commercially and/or have been published.

One system of piddling a textile rope has involved using a pair of toothed rolls to pull a tow from the primary (withdrawal) spinning rolls. Such toothed rolls, often referred to as gear rolls, gear plaiters or sunflower rolls, are available on piddler systems marketed by IWKA, Neumag, and Fleissner, for example. In these units, the toothed rolls are intended to pull the tow strand from a previous roll and to release the strand in such a way that it (1) does not wrap any rolls, and (2) is distributed so as to land softly in the can. To accomplish the first objective (a low wrap potential), large diameter rolls are used with many teeth to provide a small fiber contact area at the tip of each tooth. To enhance release of the filaments, the teeth are often coated with a low friction material and the surface speed of the toothed rolls is often greater than the speed of the moving tow band to enable the teeth to slip over the fibers and to avoid developing too much static friction. A soft landing of the moving tow line into the can is caused primarily by converting a large portion of the velocity of the moving tow band into a horizontal component. This is accomplished primarily by intermeshing the teeth from the two adjacent rolls so that the tow band folds upon itself. The vertical component of the velocity is further reduced by the tendency of filaments to adhere intermittently and momentarily to the teeth, which can cause the band to pull off its centerline and/or to open. We have noted several problems with this type of piddler. Their use is often limited in practical operations to low speeds of less than 1000 m/min owing to the difficulty of moving such (large diameter) sunflower rolls at high revolutions; we have experienced increased incidence of wraps at higher speeds. In addition, for a given product, we have found that the operating range of this type of equipment can often be relatively narrow, especially with certain types of filaments. In many instances, we have found that a mesh between the rolls that is too loose will result in poor can lay and resultant tangles, while a mesh that is too tight will result in the tow line wrapping the sunflower rolls. Wraps have also frequently been caused by wear and chipping of any low friction coating applied to the tooth surfaces. The higher speed of the sunflower roll teeth relative to the fibers can also result in broken filaments, which in turn can lead to dark dyed sections in subsequent fiber or fabric processing. Sometimes maintaining tension between the sunflower rolls and previous rolls has also been difficult. The nature of this type of piddler requires that only a light force be imparted on the filaments by the faster moving sunflower rolls since it is not desired to stretch the filaments at this point and since the higher speeds and/or tighter roll mesh required to give more tension can also result in sunflower roll wraps. To summarize, various problems have been experienced in practical operation of the toothed roll systems that are available commercially and improvements are desirable, especially when processing certain specific types of filaments on such toothed roll piddler systems.

Multifilamentary tows are not the only filamentary strands that have been laid down in the published art. Tillou in U.S. Pat. No. 3,270,977, Martin in U.S. Pat. No. 3,052,010, and Pflugrad in U.S. Pat. No. 3,135,038, disclose distributing strands referred to as tinsel conductors for telephone cords.

Disclosures of using a pneumatic jet for piddling textile strands date back almost 50 years, e.g., Koster in U.S. Pat. No. 2,447,982, Burns in U.S. Pat. No. 2,971,243, King et al in U.S. Pat. No. 3,706,407, and Goodner in U.S. Pat. No. 3,387,756. Burns required the force of the air to be sufficient to pull a tow (e.g., of synthetic polyester filaments) traveling at a speed of as much as 2500 ypm (2300 m/min) under a high tension while being below the tension required to draw the filaments. All of the above prior suggestions for using a pneumatic (or aspirating) jet piddler required rotating mechanical parts and angling of a discharge tube away from the tow line's vertical inlet position, which require complex apparatus, often in relation to rotating air joints and seals, and their maintenance.

SUMMARY OF THE INVENTION

In contrast, according to the present invention, a single fixed jet with no moving parts may be positioned directly above the can into which the strand is piddled. This jet may be positioned vertically and requires no mechanical device or discharge tube to bend the tow line and provide the horizontal component of the discharge velocity. Instead, the velocity of the tow line is translated into both a vertical and a significant horizontal component by the use of vortexing or swirling air within the jet. The amount of vortexing air may be adjusted relative to the total air entering the aspirating jet to regulate the size and frequency of the circular pattern the tow line assumes as it emerges through a tailpiece which need not rotate. Surprisingly, we have found advantages in that the emerging tow line has been able to enter the can softly in such a manner that entanglements are reduced and may be avoided completely when the tow is subsequently removed from the can. A tow can thus be pulled at speeds equal to and greater than those for earlier aspirating jets, because of problems which have tended to limit the speeds achievable in practice using the earlier devices. We have, for instance, achieved speeds of 2000 mpm using our novel device.

According to one aspect of the present invention, therefore, we provide an aspirating jet piddler 14, comprising inlet tube 24 and outlet pipe 29, for passing a textile tow line 11 down therethrough in an axial direction, and outer housing 27 provided with a fluid inlet port 23 for aspirating fluid, said inlet tube 24 and said outer housing 27 providing therebetween an annular space 28 for passing said aspirating fluid therethrough, whereby said aspirating fluid is enabled to pull the tow line down through and out of said inlet tube 24 and into said oulet pipe 29, wherein an improvement comprises a second fluid inlet port 22 into said outer housing 27, said second fluid inlet port 22 being located and arranged to direct fluid in a direction off-center with regard to said axial direction whereby motion in a swirling direction within said outer housing 27 is imparted to fluid entering said outer housing 27 and to said textile tow line 11 as it emerges from the aspirating jet piddler 14 through said outlet pipe 29.

According to another aspect of the invention, we provide an improved process for depositing a textile strand gently in a can, comprising using an aspirating jet piddler, wherein the improvement comprises imparting a swirling motion to the textile strand that emerges from the aspirating jet piddler by imparting a swirling motion to fluid within the aspirating jet piddler.

Also provided are other apparatus and process aspects, and products therefrom, as disclosed herein.

The improvements according to the invention may be incorporated into a piddler system according to the prior art, such as one of the sunflower or gear piddlers that are commercially available, or may be substituted as a replacement for a commercially available system.

Placement of the tow may be into any of several can and laydown configurations. Typical laydown systems, all of which are applicable to the present invention, include those that move a can in both X and Y directions, those in which a can rotates, those where a cylindrical, motionless can is used, those in which a round can both rotates and traverses, those in which a piddler head traverses while the can spins and other possible configurations. This novel piddler facilitates by simplifying machine design and allows for even deposition of a rapidly moving tow into a can in such a way that a large quantity can be placed in a can and thus reduce down time, e.g., in a subsequent processing step.

DESCRIPTION OF PREFERRED EMBODIMENTS

Figure 1:
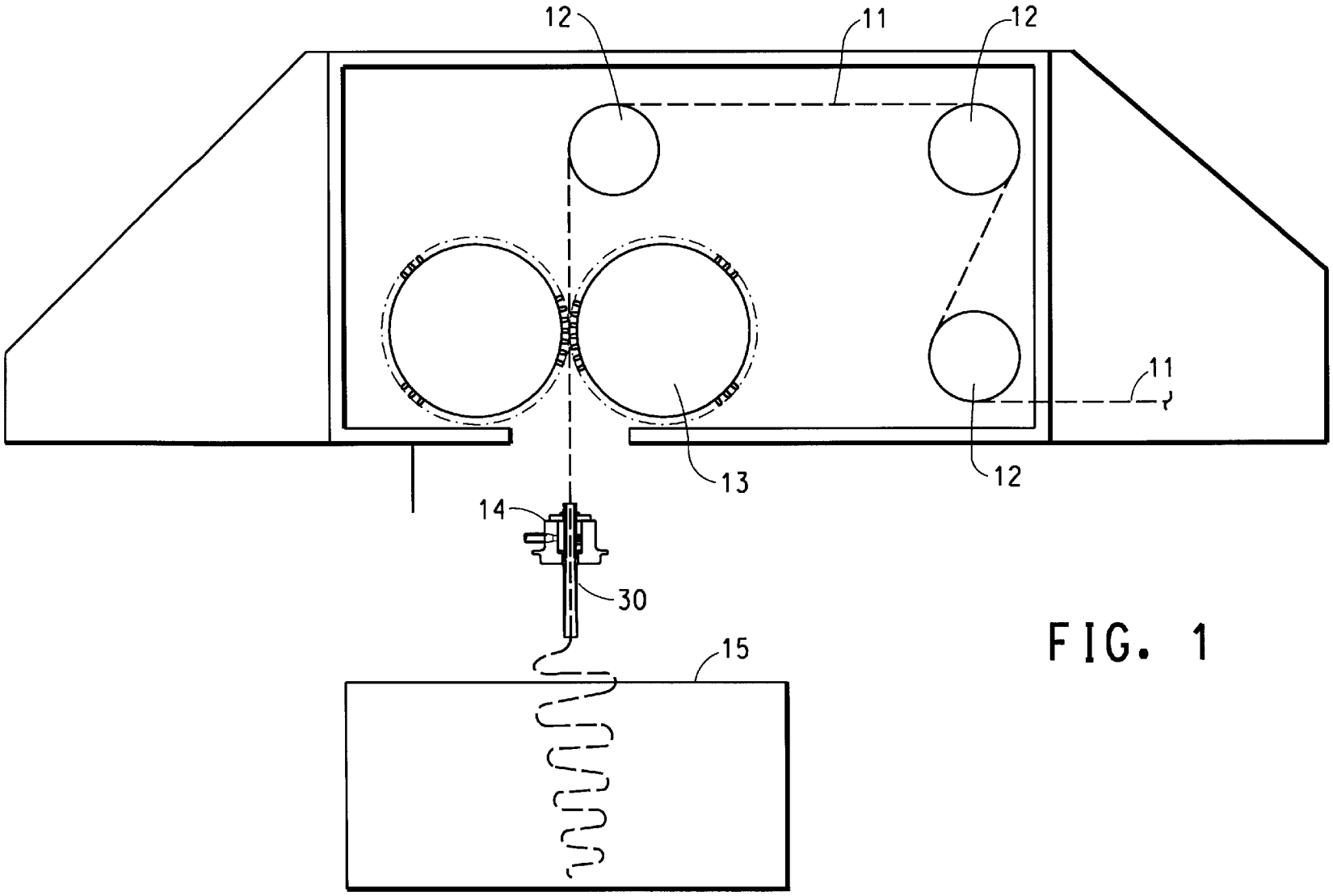
FIG. 1 is a schematic illustration in elevation of one embodiment of the invention, in combination with a sunflower roll piddler system.
Figure 2:
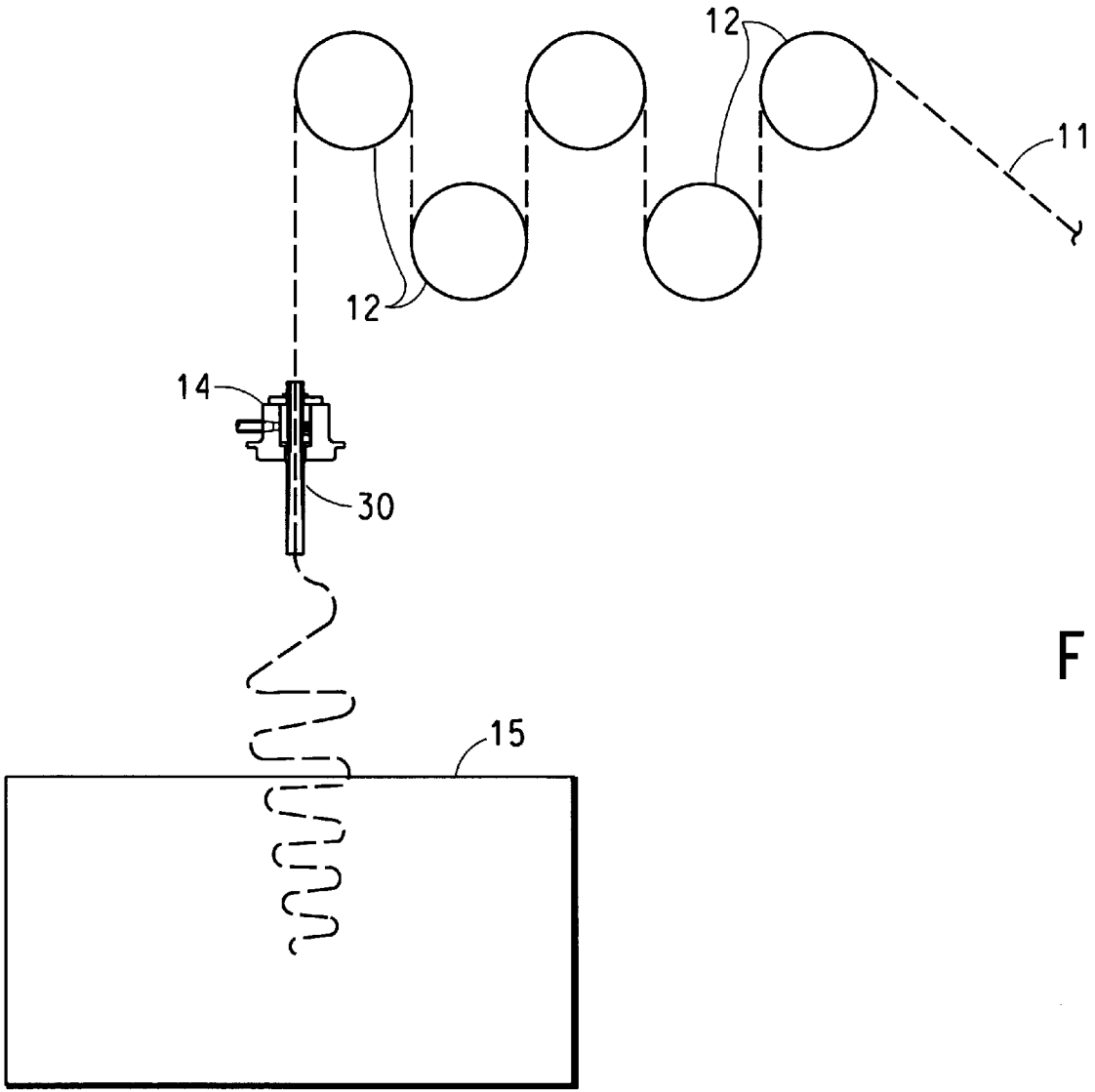
FIG. 2 illustrates similarly an embodiment of the invention as part of a preferred piddler system without the sunflower roll.
Figure 3:
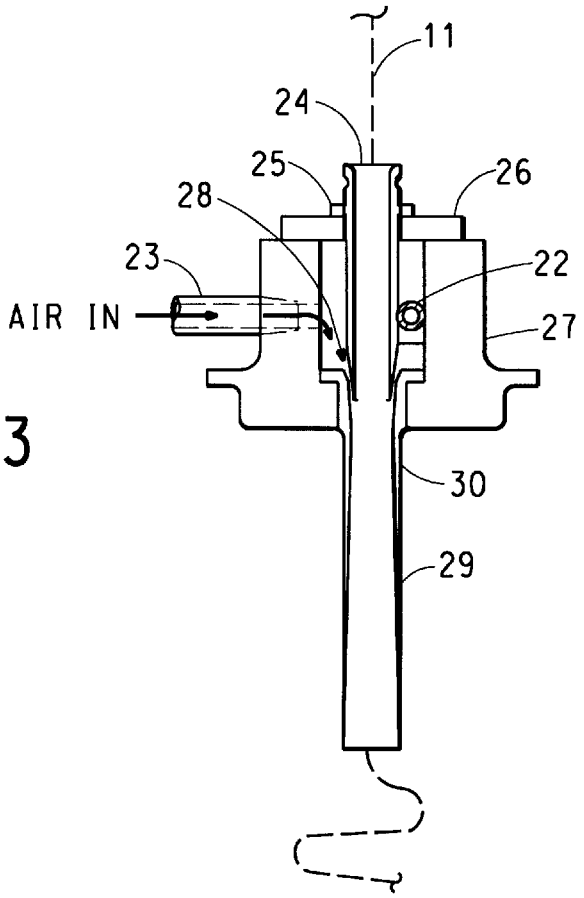
FIG. 3 is a schematic view in elevation and in section of a preferred embodiment of the invention.
Figure 4:
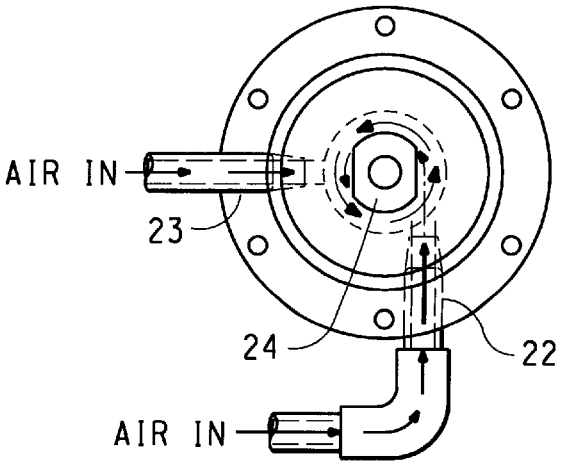
FIG. 4 is a similar plan view from above of the embodiment of FIG. 3.

Referring to the drawings, FIGS. 3 and 4 illustrate the jet piddler which is shown generally as 14 in FIGS. 1 and 2. In FIG. 1, the jet piddler is shown in combination with "Sunflower rolls" 13 of a commercial piddler unit. In this unit, a moving tow line 11 is pulled by rolls 12 from a spinning machine. Sunflower rolls 13 pull the tow line 11 from rolls 12. Thus far, FIG. 1 follows practice in a conventional commercial piddler system. Then, according to the invention, our stationary piddler jet 14 pulls the tow line 11 from the sunflower rolls 13 and deposits it into a can 15. In FIG. 2, the jet piddler 14 is shown in a preferred embodiment where a tow line 11 is pulled from a spinning machine by a set of rolls 12 from which it is pulled by the stationary piddler jet 14 and deposited into can 15.

In FIGS. 3 and 4, the tow line 11 enters the jet via inlet tube 24, and emerges from outlet pipe (a tailpipe) 29, shown in FIG. 3, outlet pipe 29 being a continuation of an outer housing 27. The stationary piddler jet itself comprises also a straight-in air inlet port 23, which directs air or other aspirating fluid into outer housing 27 in a direction perpendicular to the tow line path 11, and a vortexing air inlet port 22, which directs air in a direction tangential to the tow line path 11. Both ports are connected to a source or sources of pressurized gas, typically air, typically in a range of 25 to 100 psig (2.75 to 8 atmospheres), these sources not being shown. The air enters outer housing 27 which is sealed by cover plate 26, and is forced to leave the housing 27 through annular space 28 between the inlet tube 24 and the outlet pipe 29, being a continuation of outer housing 27. Outlet pipe 29 is provided with a diverging nozzle 30 as shown in FIGS. 1–3. The motive force of the air may be controlled by the relationship between inlet tube 24 and outlet pipe 29 which creates the annular space 28 and may be adjusted by raising or lowering inlet tube 24 which may be externally threaded, e.g., to the cover plate 26, and may be secured in place, e.g., by lock nut 25. The air inlets are conveniently located so that the straight-in air from port 23 travels through the annular space in a direction essentially parallel to that of the moving tow line 11, whereas vortexing air should swirl or spiral through the annular space in a direction roughly tangential to that of the tow line 11 so that it spirals through the outlet pipe 29. As the tow line spirals through the diverging nozzle of the outlet pipe, the tow line gently spirals and is deposited in a can. The entrained tow line 11 is thus not only pulled downward through the jet but a swirling force is created which causes the fiber band also to swirl spirally (in a circular pattern) as it exits the jet through outlet pipe 29. The amount of spiral provided to the band may be controlled by regulating via an external valve (not shown) the amount of vortexing air allowed to enter the jet housing 27 via port 22.

It will be noted that this novel air jet piddler has no moving parts, which is an important practical advantage, both for simplicity of manufacture, and in practical operation and maintenance.

EXAMPLES

The invention is further described in the following Examples, which include comparative data to demonstrate advantages achieved by the use of the present invention; all parts and percentages are by weight.

COMPARISON A

A tow of polyester filaments was processed according to the prior art, utilizing a gear piddler (such as commercially available from IWKA, Karlesruhe, Germany) to pull a rope band of unoriented as-spun filaments from a spinning apparatus and to deposit said tow strand in a can. The polyester filaments were bicomponent filaments prepared essentially as described in U.S. Pat. No. 5,458,971, the combined polymer throughput being 182 lbs. per hr. (82.6 Kg/Hr.), and the ratio of polymer A to polymer B was 78:22. At speeds above 600 ypm (549 m/min) slippage on the piddler rolls was observed, and was so severe that run times were limited to 30 minutes or less before the rope band would wrap one of the rolls and force us to shut down the machine completely.

EXAMPLE 1

To overcome this problem experienced in Comparison A, a stationary air jet was added according to an embodiment of the invention below the nip of the piddler's gear rolls, essentially as illustrated in FIG. 1. This stationary air jet is designed so that air enters the jet housing from two locations. The first air inlet port is situated such that the air directly impinges on the tube surrounding the filaments and thus flows out of the jet past the tube's tip in a direction parallel to and entraining the filaments. The second air inlet is situated such that the air enters in a direction that is tangential to the direction of flow of the filaments. This causes a vortexing effect on the entrained filaments and causes them to spiral as they leave the jet's tailpiece. The suction power of the jet can be controlled by regulating the air pressure and flow. In addition, by regulating the ratio of the vortexing air to the other air, the amount of spiral imparted on the rope band can be controlled.

With the jet described above, similar tow processed as described for Comparison A was spun at speeds up to 1360 ypm (1244 mpm). Tension throughout the piddler was good and the band displayed no tendency to wrap the piddler rolls when this piddler was used according to the invention.

EXAMPLE 2

A comparative test was run with tow processed essentially as described in Example 1 at a speed of 500 ypm (457 mpm), and the resulting tow was then processed through a draw machine equipped with a device that detects knotted rope before it enters the draw machine's feed section. The machine's logic controls will then shut the machine down to prevent a knot from damaging the equipment. Tangles and knots were recorded for the product produced according to the present invention and compared to historical data over a six month period on the same product produced previously without using the stationary air jet according to the invention (i.e., essentially as described for Comparison A) at 500 ypm.

TABLE 1

| ITEM | TANGLES PER 100 RUN HOURS |
|---|---|
| A | 132.5 |
| INV | 78.6 |

As can be seen, use of the stationary air jet according to the invention produced a can lay pattern which reduced the number of tangles during extraction from the can to about 60% of the number recorded as experienced previously.

As will be understood, the brief description above has concentrated on explaining the jet that was actually used in practice, and modifications and variations can easily be made according to the invention.

What is claimed is:

1. A piddler for collecting a rapidly moving tow line and depositing said tow line into a can, wherein said piddler comprises an aspirating jet, comprising an inlet tube and an outlet pipe, for passing said tow line down therethrough in an axial direction, and an outer housing provided with a straight-in fluid inlet port for introducing aspirating fluid into the outer housing in a direction perpendicular to the tow line path, said inlet tube and said outer housing providing therebetween an annular space for passing said aspirating fluid therethrough, said outlet pipe provided with a diverging nozzle, whereby said aspirating fluid is enable to pull the tow line down through and out of said inlet tube and into said diverging nozzle so that the tow line spirals and is deposited in a can, wherein a further improvement comprises a second fluid inlet port connected to said outer housing, said second fluid inlet port being located and arranged to direct fluid in a direction tangential to the tow line path whereby motion in a swirling direction within said outer housing is imparted to fluid entering said outer housing and to said tow line as it emerges from the aspirating jet through said outlet pipe, and wherein said piddler has no moving parts.

2. A process comprising using an aspirating jet piddler to deposit a tow line gently into a can, wherein the improvement comprises directing aspirating fluid into the aspirating jet piddler in a direction perpendicular to the tow line path, and imparting a swirling motion to fluid within the aspirating jet piddler by directing fluid in a direction tangential to the tow line path, and further comprises passing the tow line through a diverging nozzle.

3. A piddler for collecting a rapidly-moving tow line and depositing said tow line into a can, wherein said piddler comprises an aspirating jet for passing said tow line down therethrough in an axial direction, said aspirating jet comprising an inlet tube and an outlet pipe, and an outer housing provided with a first fluid inlet port for introducing aspirating fluid into the outer housing in a direction perpendicular to the tow line path and a second fluid inlet port for introducing air in a direction tangential to the tow line path.

* * * * *